US005857271A

United States Patent [19]

Pallatin

[11] Patent Number: 5,857,271

[45] Date of Patent: Jan. 12, 1999

[54] SPORTS BOOT EQUIPPED WITH AN IMMOBILIZATION DEVICE DURING THE PIVOTING OF THE UPPER

[75] Inventor: Pascal Pallatin, Gresy Sur Aix, France

[73] Assignee: Salomon S.A., Metz-Tessy, France

[21] Appl. No.: 922,361

[22] Filed: Sep. 3, 1997

[30] Foreign Application Priority Data

Sep. 4, 1996 [FR] France ..... 96 10873

[51] Int. Cl.[6] ..... A43B 5/04

[52] U.S. Cl. ..... 36/118.4; 36/118.8

[58] Field of Search ..... 36/118.4, 118.3, 36/118.8

[56] References Cited

U.S. PATENT DOCUMENTS 5,265,352 11/1993 Chemello ..... 36/117
5,283,964 2/1994 Chemello ..... 36/117
5,457,899 10/1995 Chemello ..... 36/117

FOREIGN PATENT DOCUMENTS 0521282 1/1993 European Pat. Off. .
0521283 1/1993 European Pat. Off. .
0582803 2/1994 European Pat. Off. .

*Primary Examiner*—Ted Kavanaugh
*Attorney, Agent, or Firm*—Greenblum & Bernstein, P.L.C.

[57] ABSTRACT

A boot having a shell base with an upper extending thereabove, the upper being pivotal in the front-to-rear and rear-to-front directions. The boot includes an immobilization device located on the upper which is adapted to cooperate with two abutment zones that are provided on the shell base. This device has a manoeuvering member equipped with a rotational cam and two mobile elements, each element being adapted to cooperate with one of the two abutment zones. The device enables the bending capacity of the upper to be modified in at least one direction, depending on the use envisioned for the boot at any given moment.

10 Claims, 5 Drawing Sheets

FIG. 8
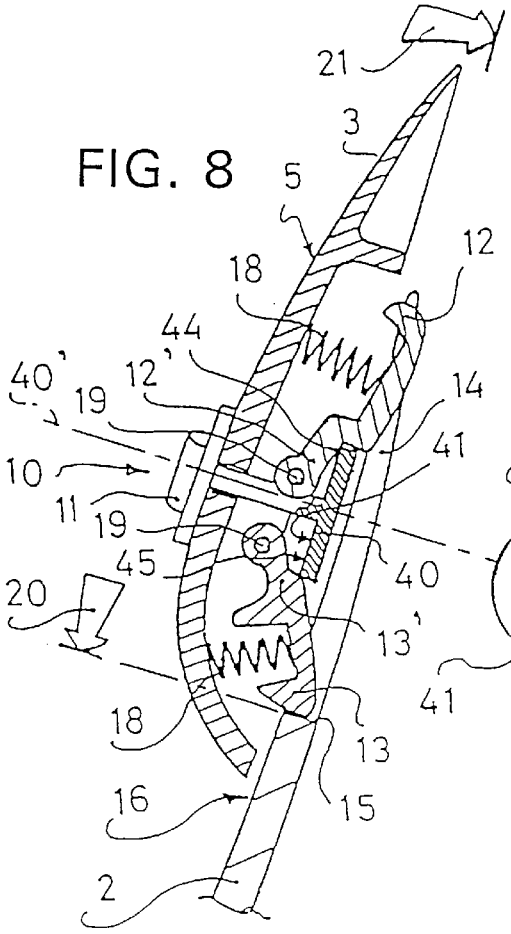
FIG. 8a
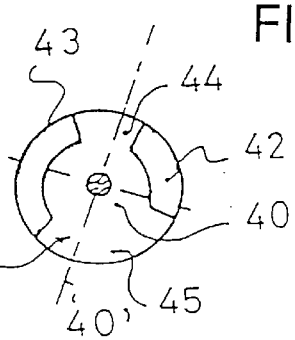
FIG. 9
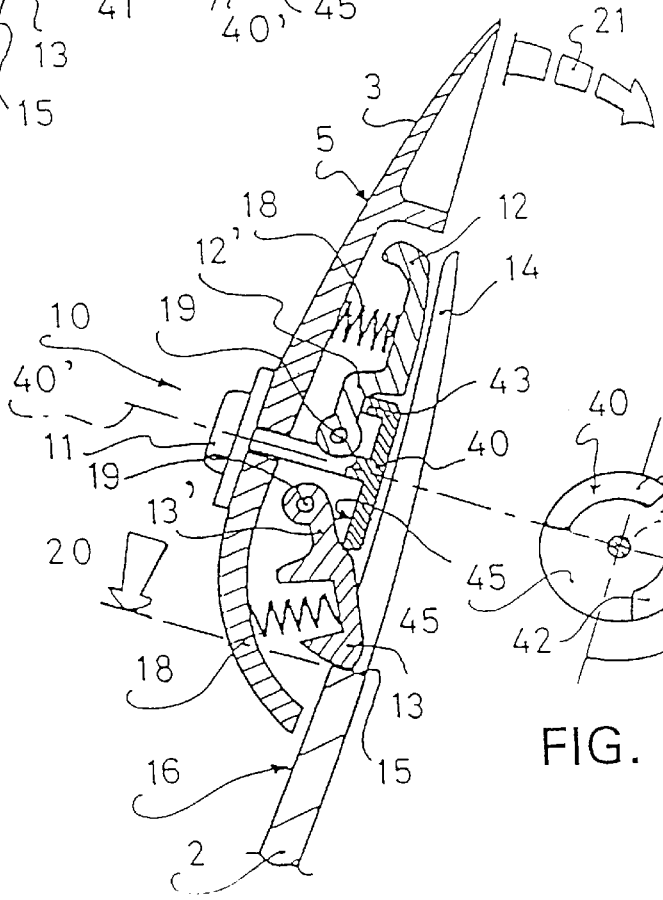
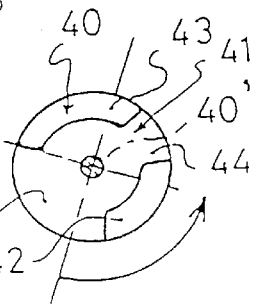
FIG. 9a

FIG. 10
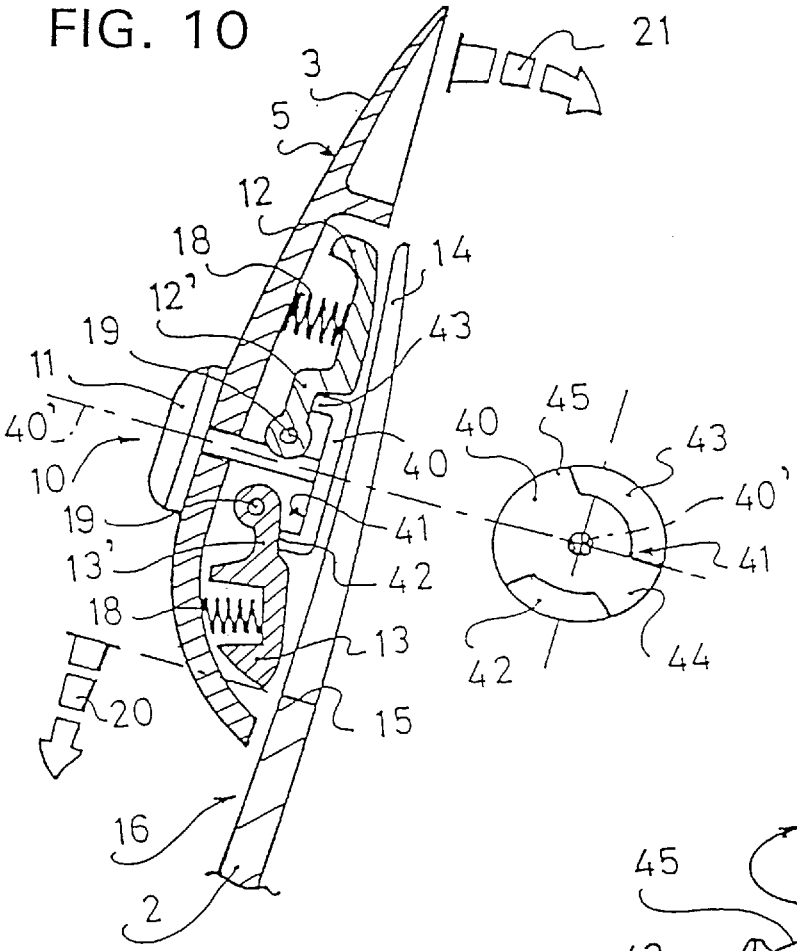
FIG. 10a
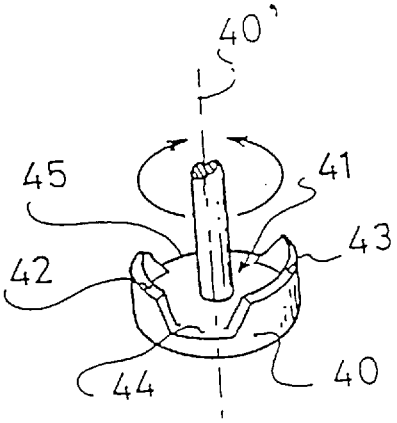
FIG. 11

SPORTS BOOT EQUIPPED WITH AN IMMOBILIZATION DEVICE DURING THE PIVOTING OF THE UPPER

BACKGROUND OF THE INVENTION

1. Field of the Invention

The present invention is related to a so-called "rigid shell" sports boot that includes a shell base overhung by an upper capable of pivoting in both directions, i.e. front-to-rear and rear-to-front, and is related to an immobilization device with respect to the shell base that is active in both the pivoting directions of the upper by means of a rotational manoeuvering member located on the latter, and is especially related to an adjustable immobilization device that is adapted to modify the bending capacity of the upper in at least one direction, depending on the type of use envisioned for the boot at a given moment.

2. Description of Background and Relevant Information

Sports boots of the above-mentioned type are known according to European Patent No. 0 521 282. According to this patent, the immobilization device of the upper with respect to the shell base is active in at least one of its pivoting directions via an abutment zone obtained on the shell base. To this end, the device is equipped with a rotational manoeuvering member including a rotational cam that acts on a mobile element which is adapted, for a given angular position of the cam, to cooperate with the abutment zone of the shell base, and for another given position of the cam, to become disengaged from the abutment zone. As has been disclosed, when the mobile element cooperates with the abutment zone of the shell base, the upper of the boot is systematically blocked towards the rear, i.e., it is forced to adopt an inclination, commonly known as the "angle of advance", and at the same time, it is stopped from any pivoting towards the front or it has a certain clearance before becoming blocked, the blocking being predetermined during construction and resulting from the adjustment between that portion of the mobile element that cooperates with the abutment zone and the upper. Inversely, when the mobile element does not cooperate with the abutment zone, the upper is unlatched, and thus free to pivot as much towards the front as towards the rear.

As is obvious, the immobilization device as described can thus modify the pivoting capacity of the upper between a skiing position, with or without any frontward bending capacity according to the predetermined construction, and a walking-relaxed position in which the upper is free to pivot. Such an immobilization device is satisfactory if all that the user requires is the frontward bending capacity of the upper which has been predetermined in advance. As a matter of fact, one only has one immobilization position in the rear-to-front direction from this immobilization position of the upper in the front-to-rear direction, thus providing only one bending capacity for the upper. However, it is a fact that according to the type of skiing being envisioned, for example, competitive skiing or leisure skiing, or according to the condition of the snow cover, i.e., deep, heavy, icy snow etc., the skier needs to increase or diminish this frontward bending capacity. The immobilization system disclosed thus proves to be ill-adapted because there is no provision, after construction, for modifying the adjustment obtained between its mobile element portion and the abutment zone of the shell base, and thus the bending possibilities of the upper, especially towards the front.

SUMMARY OF THE INVENTION

An object of the instant invention is to overcome the foregoing disadvantage in the sports boots described hereinabove, and to this end, it sets forth an immobilization device for the upper of a sports boot that is adapted, in a given angular position of a rotational cam controlled via a rotational manoeuvering member, to immobilize the upper of a boot in the rear-to-front direction in view of the type skiing envisioned, by simultaneously providing the upper with a certain bending capacity in the rear-to-front direction before becoming blocked, and in another given angular position of the cam, still guaranteeing the immobilization of the upper in the rear-to-front direction, by simultaneously providing the upper with another bending capacity, perhaps even by eliminating the latter. In fact, the invention provides, for a constant immobilization position of the upper in the front-to-rear direction, two possible immobilization positions in the rear-to-front direction, thus determining two different bending capacities for the upper.

Another object of the invention is to enable the upper to become released while pivoting in the front-to-rear direction so as to, for example, facilitate walking, putting on and removal of the boot, by bringing the rotational cam into at least one intermediate angular position located between the previous angular immobilization positions of the upper, and this is done while allowing the upper a certain bending capacity in the rear-to-front direction.

In order to achieve these objects, the rigid shell sports boot has, as was the case in the state of the art constituted by the patent EP 0 521 282, a shell base overhung by an upper adapted to pivot in both directions, front-to-rear and rear-to-front, the upper being equipped, in its dorsal zone, with an immobilization device with respect to the shell base that is active in at least one of these pivoting directions, by means of an abutment zone obtained on the shell base. The immobilization device is equipped with a manoeuvering member provided with a rotational cam that acts on a mobile element adapted to cooperate, in a given angular position of the cam, with the abutment zone of the shell base.

According to the sports boot of the invention, the immobilization device comprises a second mobile element that can be actuated by means of the rotational cam and is adapted to cooperate with a second abutment zone obtained on the shell base for at least one given angular position of the cam. The cooperation of this second mobile element with this second abutment zone is intended to bring about the immobilization of the upper in one of these two pivoting directions, whereas the cooperation of the first mobile element with the first abutment zone brings about the immobilization of the upper in the second of the two pivoting directions.

The simultaneous implementation of the two mobile elements with the two abutment zones thus causes the immobilization of the upper of the boot in both pivoting directions, and the implementation of a single mobile element with its abutment zone only causes the immobilization of the upper in one pivoting direction. Inversely, the simultaneous disengagement or retraction of both mobile elements causes the upper to become released in both pivoting directions, whereas the disengagement of one of the mobile elements only causes the release of the upper in one pivoting direction.

Thus, one has at least three possibilities for modifying the pivoting ability of the upper, and this allows for the optimization of the role of the boot, especially when other accessory elements or equipment necessary for the sport, such as skis, skates, crampons, etc., are affixed on it in order to modify the traditional walking or racing motions.

According to one characteristic, the rotational cam of the immobilization device is constituted of a plate, which when on an axis on the manoeuvering member, comprises at least one circular sensor surface having a high working zone and a low working zone, and both mobile elements of the device cooperate with this sensor surface by means of sensor elements with which they have been respectively equipped.

According to another characteristic, the sensor members of the mobile elements come into contact with the sensor surface of the cam at a distance from one another, each along one of the high and low working zones, at opposite points with respect to the rotational axis of the manoeuvering member.

According to one embodiment of the immobilization device, the plate constituting the rotational cam comprises two sensor surfaces, that is one on each face, parallel to one another, and each having a high working zone and a low working zone, each mobile element cooperating with one of the two sensor surfaces by means of its sensor member.

According to another embodiment of the immobilization device, the plate constituting the rotational cam comprises a single sensor surface having, over 360°, two humps in the shape of arcs of a circle, having the same height and different lengths, defining between them two notches that are symmetrically opposed to them with respect to the rotational axis of the cam, and thus of the manoeuvering member, the humps constituting the high working zone and the notches constituting the low working zone.

According to a preferred characteristic of the invention, the two abutment zones of the shell base are obtained and located in the heel zone thereof, each abutment zone being adapted to ensure the immobilization of the upper in one if its pivoting directions in cooperation with one of the two mobile elements of the immobilization device and in at least one given angular position of the rotational cam.

According to one embodiment, the two abutment zones of the shell base are constituted, one by a vertical scallop open towards the top and demarcated by flexible edges for its rear-to-front immobilization, and the other by its shoulder for its front-to-rear immobilization.

In this embodiment, the abutment zone constituted by the scallop is located above the zone constituted by the shoulder. It is covered by the dorsal zone of the upper and is adapted to cooperate with one of the mobile elements that can, selectively, under the rotational action of the cam and in one of the predetermined angular positions thereof, become retracted from the scallop or become inserted between its flexible edges, whereby bringing about a certain possibility for the rear-to-front pivoting of the upper or its immobilization in this direction. Indeed, when the mobile element of the immobilization device is retracted from the scallop, the flexible edges of the latter can come closer together by elastic deformation under the thrust effect of the dorsal zone of the upper that covers it and that describes an engagement path along the heel zone of the shell base in the area of the scallop. Naturally, it is understood that this pivoting possibility is only permitted when the bending force applied on the upper is greater than the resisting force that is offered by the flexible edges of the scallop. In the other position of the mobile element, that is when the latter cooperates with the scallop by becoming inserted between the flexible edges under the action of the rotational cam, for a given angular position thereof, the flexible edges become hindered from any reciprocal coming together because they abut on the mobile element; consequently, the flexible edges of the scallop resist the thrust of the dorsal zone of the upper which can no longer describe its engagement path along them. The scallop thus constitutes the abutment zone of the shell base, capable of immobilizing the upper in the rear-to-front direction, and according to the given angular position of the rotational cam by means of the manoeuvering member, the abutment zone is also capable of allowing a certain bending possibility for the upper in the rear-to-front direction.

Relative to the scallop, the shoulder that constitutes the second abutment zone is located beneath and transversely to the latter, and is also located in the heel zone of the shell base, and it is the second mobile element of the immobilization device, that is, the element that is not associated functionally with the scallop that is adapted to cooperate therewith. According to a preferred construction, this mobile element takes support on the shoulder under the action of the rotational cam, in a given angular position thereof, and especially when the upper is stressed to bend in the front-to-rear direction.

BRIEF DESCRIPTION OF THE DRAWINGS

The invention and certain of its characteristics will be better understood with reference to the following description and the annexed schematic drawings that illustrate, as examples, two typical embodiments, and wherein:

FIGS. 8, 9 and 10 illustrate another immobilization device for the upper of the boot of FIG. 1 in a partial sectional view along line V—V as per a second embodiment of the invention, in the three adjustment positions corresponding to the those represented in FIGS. 1, 2 and 3;

FIG. 11 represents a perspective view of the end or plate of the rotational cam of the immobilization device of FIG. 8 and highlights its sensor zone;

FIGS. 8*a*, 9*a* and 10*a* are planar views of the position of the sensor zone of the rotational cam for each of the three adjustment positions of the immobilization device of FIGS. 8, 9 and 10.

DETALED DESCRIPTION OF THE PREERRED EMBODIMENTS

Figure 1:
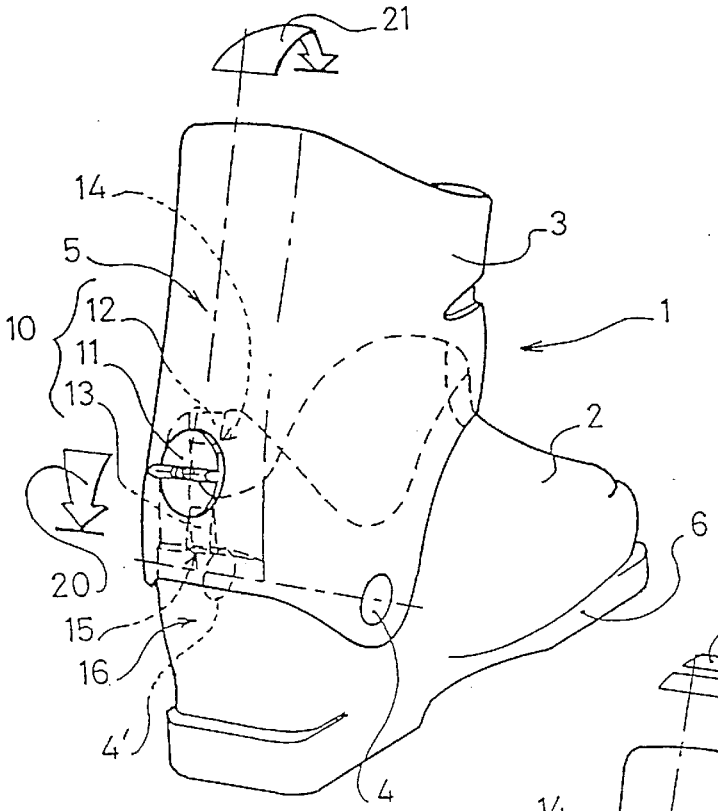
FIGS. 1, 2 and 3 illustrate three adjustment positions of an immobilization device according to the invention, and its action on the pivoting possibilities of the upper of the boot in the rear-to-front and front-to-rear directions.
Figure 2:
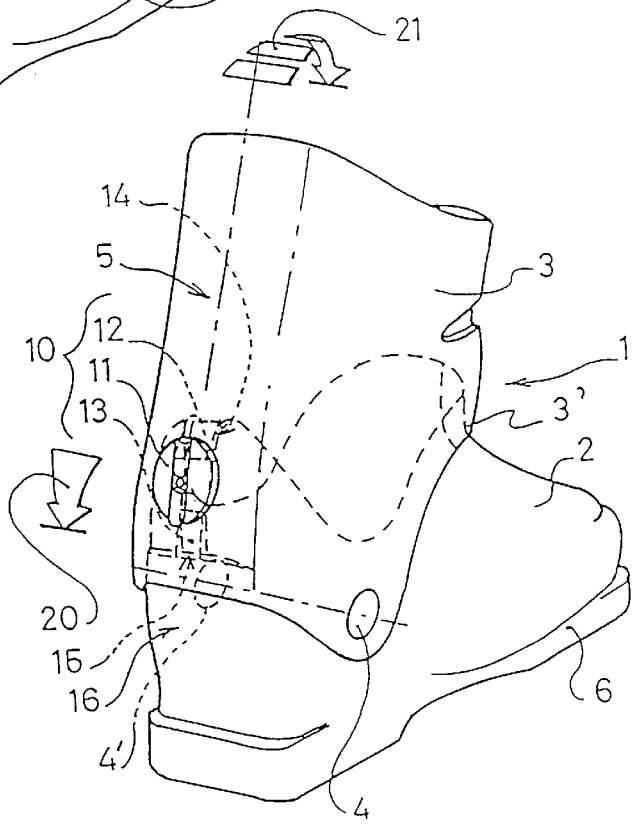
Figure 3:
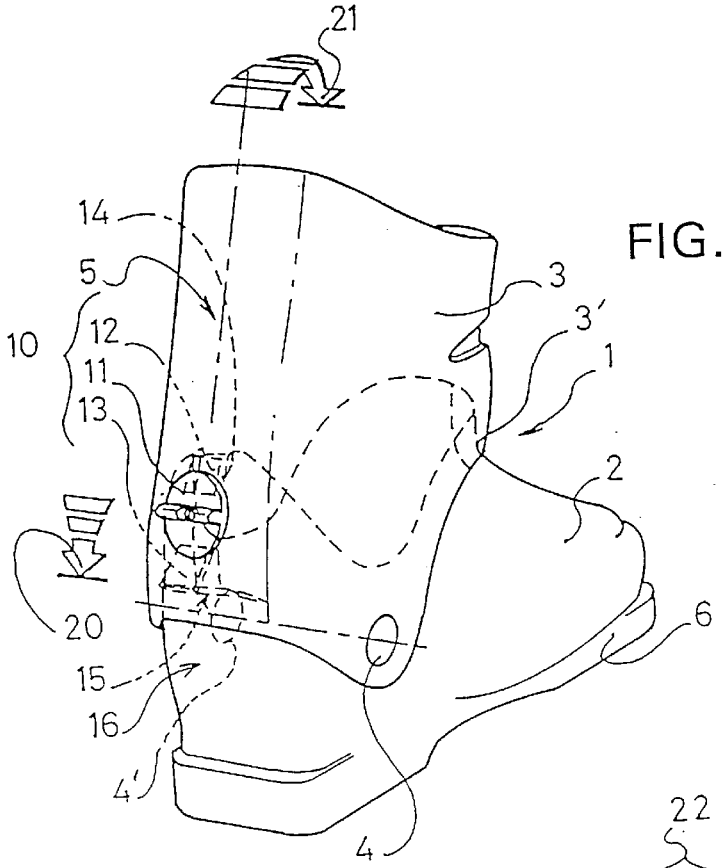

The boot, designated in its entirety as 1, is a non-limiting example, and as represented in FIGS. 1 through 3, is of the "front entry" type.

This boot 1 is constituted of a so-called rigid shell, having a shell base 2 equipped with a sole 6, and overhung with an upper 3 capable of pivoting thereon in the front-to-rear direction as indicated by the arrow 20, and in the rear-to-front direction as indicated by the arrow 21, by rotating about the lateral connections 4, 4' preferably located in correspondence with the joint of the ankle of the wearer, not represented. An immobilization device 10 located on the dorsal zone 5 of the upper 3 is equipped with a rotational manoeuvering member 11, accessible from the outside of the shell of the boot, to which two mobile elements 12, 13 are displaceably secured by means of a rotational cam (not represented) with which it is equipped.

Two abutment zones 14 and 15 are located or formed in the heel portion 16 of the shell base 2 in correspondence with the mobile elements 12, 13 of the immobilization device 10. As such, these elements 12, 13 can cooperate with the abutment zones 14 and 15 after a displacement generated by the rotational cam, in at least one given angular position of the rotational cam, or of the manoeuvering member equipped therewith. These abutment zones 14 and 15 are oriented so as to resist the pivoting of upper 3 in the front-to-rear direction 20 and/or the rear-to-front direction 21, when the element 12 and/or 13 cooperates with it. In fact, when the two elements 12 and 13 are implemented on the abutment zones 14 and 15, the upper 3 of the boot is immobilized in both pivoting directions 20 and 21 as has been represented in FIG. 1. Thus, one has a "stiff" boot because its upper 3 has practically no degree of freedom while pivoting. The result of this immobilization is that the stresses and forces intervening between the leg of the wearer and the sole 6 of the boot and/or the sports equipment or accessory affixed to the boot 1 are transmitted almost instantaneously from the upper 3 to sole 4 and vice versa. Such a behavior of boot 1 is especially advantageous when the wearer must display quick reaction, for example, during competitive sports, because the stiffness thus conferred to upper 3 enables him to feel the smallest variations in his supports and thus react accordingly.

In another position, represented in FIG. 2, only the mobile element 13 cooperates with the abutment zone 15. The upper 3 thus remains immobilized in the front-to-rear direction 20 but is capable of a certain amount of bending in the rear-to-front direction before becoming blocked by the support of its front edge 3' on shell base 2 in the zone corresponding to the instep. Thus, in this case one has a boot that is "stiff" in the front-to-rear direction 20 and relatively flexible in the rear-to-front direction 21, which is something often looked for in sports requiring less reactiveness from the wearer, or when the latter wants a certain amount of bending freedom in the rear-to-front direction 21.

Again, as illustrated in FIG. 3, when the two mobile elements 12 and 13 are retracted from the abutment zones 14 and 15, the upper 3 is thus free to pivot with a certain amplitude in both directions, that is the rear-to-front direction 21 and the front-to-rear direction 20, about its connections 4, 4' with respect to shell base 2. In this adjustment of the immobilization device 10, the boot 1 is provided with a substantial flexibility of upper 3, and this is advantageous in facilitating walking and/or putting on or removing the boot, for example.

Figure 4:
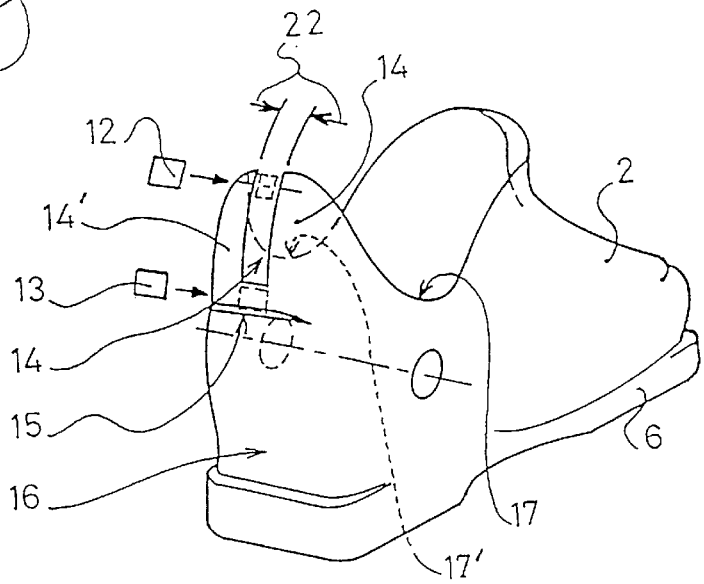
FIG. 4 is a schematic illustration of an embodiment detail of the two abutment zones obtained in the heel portion of the shell base of the boot of FIGS. 1 through 3.

According to a preferred embodiment illustrated in FIG. 4, the abutment zone 14 covered by the dorsal zone 5 of upper 3 (not illustrated) is constituted of a vertical scallop obtained in the heel portion 16 of the shell base 2. This vertical scallop 14, open upwardly, is demarcated by flexible edges 14'. These are adapted to come closer together, in a reciprocal manner, by elastic deformation, such as indicated by the arrows 22, under the thrust effect of the dorsal zone 5 of upper 3, when the upper 3 pivots in the rear-to-front direction 21 about its connections 4, 4', and when the mobile element 12 is not inserted between them; it is understood that the force applied on upper 3 must be greater than the resisting force provided by the flexible edges 14' in order to obtain some bending. Lateral cut outs 17, 17' can possibly be obtained in shell base 2, relatively towards the front of the heel portion 16 thereof, so as to decrease the resistance to bending of the edges 14' of the scallop, and thus to provide the upper 3 of the boot with a certain flexibility in the front-to-rear direction 20 that could be possible with little force. It is clear that the range and shape of such lateral cut outs 17, 17' are provided constructionally, during the definition of the structure of the shell base 2, depending on the initial shock absorption desired at the level of upper 3.

In the engagement position of the mobile element 12 between the flexible edges 14' of the scallop 14 under the action of the rotational cam (not represented) of the immobilization device 10, the thrust exerted by the dorsal zone 5 of the upper 3 can no longer cause the coming together of edges 14', and it is therefore the heel portion 16 of the shell base 2 that generally resists the bending of upper 3 in the rear-to-front direction. In fact, in this position of the mobile element 12, the upper is almost completely blocked or immobilized towards the front.

Relative to scallop 14, the second abutment zone 15 is located beneath it, and is present in the form of a transverse shoulder, approximately perpendicular to the scallop 14. The second mobile element 13 of the immobilization device 10 is adapted to cooperate with this shoulder 15 by taking support on it under the action of the rotational cam (not represented) of the immobilization device 10 only when the upper 3 is stressed to pivot in the front-to-rear direction 20.

As such, regardless of the position of the mobile element 13, i.e., whether it is in the cooperation position with the abutment zone 14 or in the retracted position, the bending possibilities of the upper 3 in the rear-to-front direction 21 remain essentially determined by the position assigned to the mobile element 12.

Figure 5:
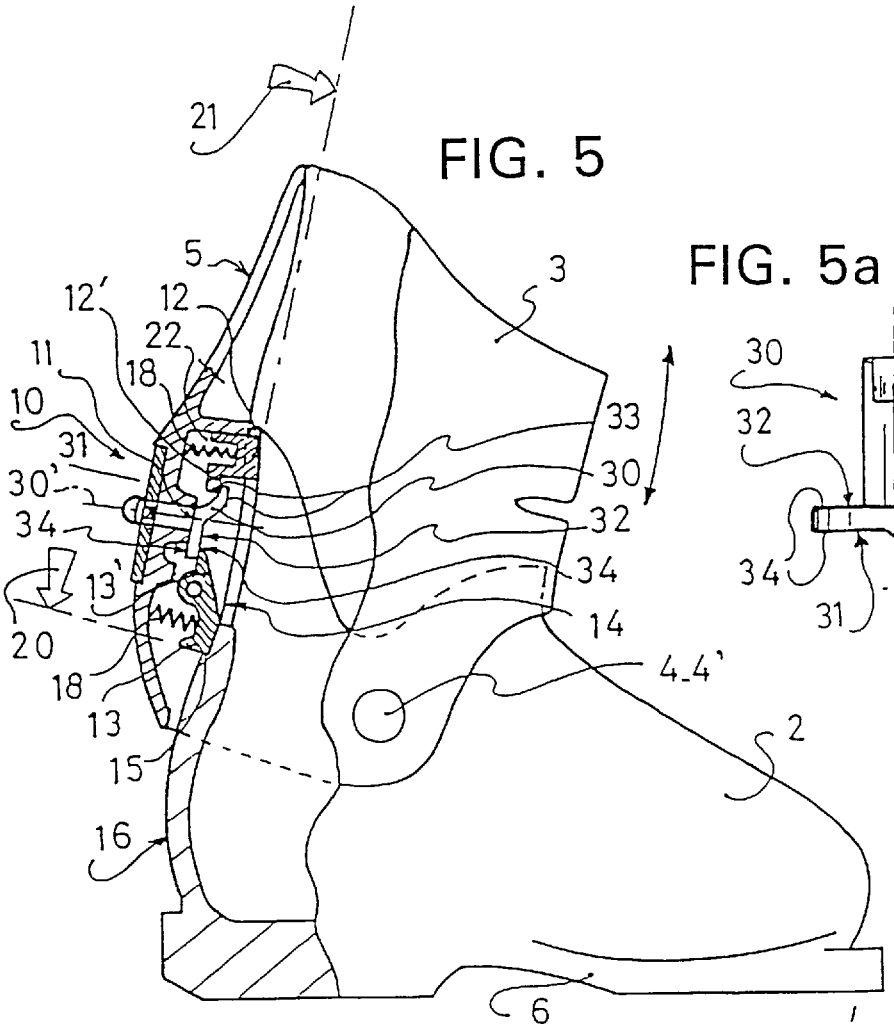
FIGS. 5, 6 and 7 represent the boot of FIG. 1 in a partial sectional view along the line V—V, and respectively show, as per a first embodiment of the invention, an immobilization device in each of the three adjustment positions of FIGS. 1, 2 and 3.
Figure 5A:
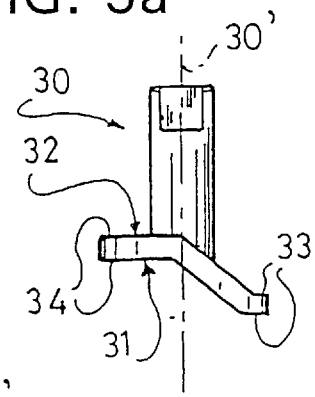
FIG. 5*a* shows an embodiment detail of the rotational cam of the immobilization device of FIG. 5.
Figure 6:
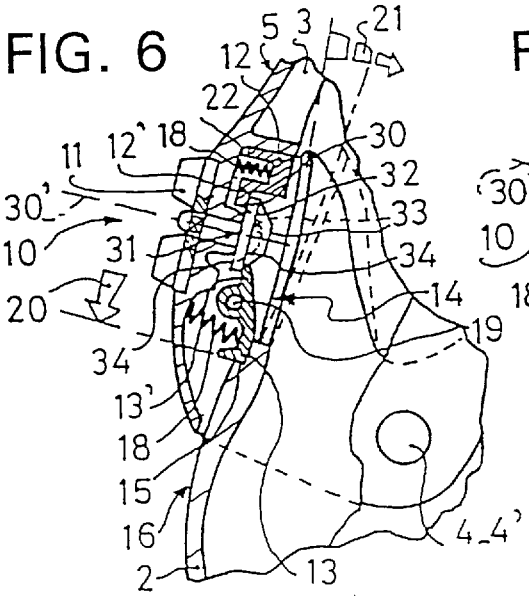
Figure 7:
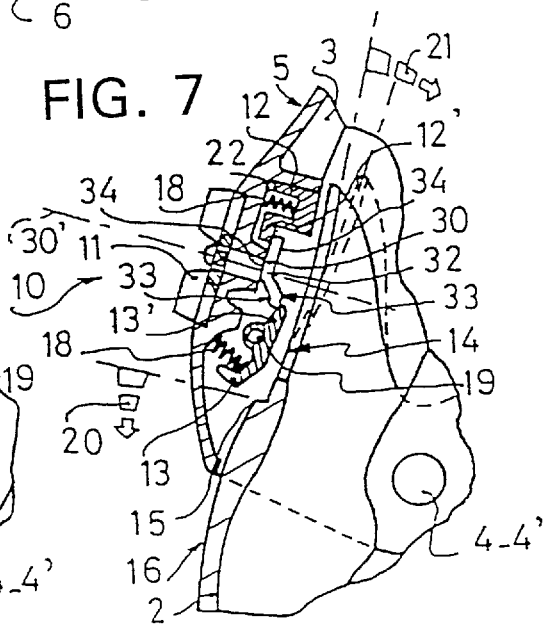

The FIGS. 5, 6 and 7 that follow illustrate an embodiment of the immobilization device 10 of boot 1 in the three adjustment positions described previously, or respectively: FIG. 5=FIG. 1, FIG. 6=FIG. 2, FIG. 7=FIG. 3. In this construction of the device 10, the rotational cam 30 is constituted of a plate comprising a sensor surface 31, 32 on each face, as illustrated in FIG. 5*a*. These sensor surfaces 31 and 32 are parallel to one another, and each has a high working zone 33 and a low working zone 34 over 360°. In this way, the high 33 and low 34 working zones are located in the same area angularly with respect to the rotational axis 30' (FIG. 5*a*) of the rotational cam 30. In addition, passage from a high working zone 33 to a low working zone 34 is obtained via a progressive ramp and extends angularly along approximately 90°. In order to cooperate with each sensor surface 31 and 32, the mobile elements 12 and 13 are each equipped with a sensor member 12' and 13', and are subjected to the action of a spring 18 ensuring that they remain in permanent contact with the surfaces 31 and 32. In this embodiment example, the mobile element 12 is pivotally mounted about an axis 19 crossing a portion of the dorsal zone 5 of the upper 3 in the vicinity of the abutment zone 15, and the mobile element 12 is slidably mounted in a guide 22 obtained in the zone 5 in correspondence with the abutment zone 14 of shell base 2. This face to face assembly of the abutment zones 14 and 15 means that the mobile elements 12 and 13, along with their sensor members 12' and 13' are located angularly at 180° from one another with respect to the rotational axis 30' of the cam 30. Consequently, from a given angular position, each 90° rotation of the cam 30 by means of the manoeuvering member 11 causes the displacement of at least one of the mobile elements 12 and 13 with respect to an abutment zone 14 or 15, and intrinsically modifies the immobilization and/or pivoting conditions of the upper 3 with respect to shell base 2.

For example, as illustrated in FIG. 5, the two mobile elements 12 and 13 are actuated on the abutment zones 14 and 15 by means of the rotational cam 30 which is placed in a given angular position enabling them to cooperate with the zones 14 and 15. More specifically, the sensor member 12' of the mobile element 12 is in contact with the high working zone 33 of the sensor surface 32 of cam 30 and the sensor member 13' of the mobile element 13 is in contact with the low working zone 34 of the sensor surface 31 of cam 30. In this adjustment position of the immobilization device 10, the upper 3 is thus immobilized while pivoting about its connections 4, 4' with respect to shell base 2, whether it be in the front-to-rear 20 or rear-to-front 21 direction.

From this given angular position of cam 30, a 90° rotation of the manoeuvering member 11 of the immobilization device 10, and thus of cam 30, as is represented in FIG. 6, only causes the retraction of the mobile element 12 with respect to its abutment zone 14, or the scallop. Indeed, the cam 30 thus presents its low working zone 34 in front of the sensor member 12' of the element 12, which zone, relative to the abutment zone 14 of the shell base 2, is further away than its high working zone 33. Inversely, it is always the low working zone 34 that is contact across from the sensor member 13' of the element 13. In this adjustment position of the immobilization device 10, the upper 3 of the boot is always stopped from pivoting in the front-to-rear direction 20, but is capable of bending in the rear-to-rear direction 21 when a force that is applied on it in this direction is enough to overcome the deformation resistance provided by the flexible edges 14' of the scallop 14.

Once again, in FIG. 7, the mobile element 13 becomes retracted in turn from its abutment zone 15 by a new 90° rotation of cam 30 from its previous position as illustrated in FIG. 6, and according to the same manoeuvering direction. Indeed, in this angular position of cam 30, it is with the high working zone 33 of the sensor surface 32 that the sensor member 13' of element 13 cooperates. This high working zone 33 being closer than the low working zone 34 relative to the abutment zone 15, it forces the mobile element 13 to tilt by that much along its axis 19 by its interspersed sensor member 13', and thus to retract only the abutment zone 15. In this other adjustment position of the immobilization device 10, the upper 3 of the boot is thus free to pivot in both directions, front-to-rear 20 and rear-to-front 21, it being understood that in order to bend in the direction 21, the force applied on it must be at least greater than the resisting force provided by the flexible edges 14' of the scallop 40 on which the dorsal zone 5 of the upper 3 takes support.

According to another embodiment of the immobilization device 10, represented in FIGS. 8 through 11 that follow, the plate 40 constituting the rotational cam comprises a single sensor surface 41 which is circular, and over 360° has two humps 42 and 43, and the two mobile elements 12 and 13 are tiltably mounted, each along axis 19. These humps 42 and 43 in the shape of arcs of a circle have the same height and different lengths, and between them they define notches 44 and 45 that are symmetrically opposed to them with respect to the rotational axis 40' of the cam 40. In this embodiment, the humps 42 and 43 constitute the high working zone, and the notches 44 and 45 constitute the low working zone. The humps 42 and 43 and the notches 44, 45 are also spaced angularly from one another so that they can act on the sensor members 12' and 13' of the two mobile elements 12 and 13, either in pairs 42 and 43 or 44 and 45, or one hump 42 or 43 with one notch 44 or 45, for a given angular position of the cam 40 via the manoeuvering member 11.

As an example, FIGS. 8 and 8*a* represent the immobilization device 10 in an adjustment position where the rotational cam 40 has two notches 44 and 45 that constitute its low working zone, in cooperation with the sensor members 12', 13' of the mobile elements 12 and 13. In FIGS. 10 and 10*a*, in another given angular position of the cam 40, it is the two humps 42 and 43 that constitute the high working zone, that cooperate with the sensor members 12' and 13' of the mobile elements 12 and 13. In comparison, FIGS. 9 and 9*a* show the cooperation of a hump 43 and a notch 45 with the sensor members 12' and 13' of the mobile elements 12 and 13 for yet another given angular position of cam 40.

As is represented, FIGS. 8, 9 and 10 illustrate the immobilization device 10 in the adjustment positions that correspond to those described previously with reference to the preceding FIGS. 1, 2 and 3. Thus, in FIG. 8, the upper 3 of the boot is immobilized in both pivoting directions 20 and 21 with respect to the shell base, in FIG. 9 in the front-to-rear direction 20 only with freedom in the opposite direction 21, and in FIG. 21, with freedom in both pivoting directions 20 and 21. However, yet other adjustment positions are possible. Indeed, cam 40 can be brought into an angular position where hump 43 cooperates with the sensor member 13' of mobile element 13, and notch 45 with the sensor member 12' of the element 12. In this case, the upper is free to pivot in the front-to-rear direction 20, and is stopped from pivoting in the rear-to-front direction (20 or 21).

It is understood that the component elements of the immobilization device 10 and/or the abutment zones 14 and 15 can be obtained differently without leaving the scope of the invention.

As such, the mobile elements 12, 13 can be provided to be mounted tiltably or slidably and kept in contact with the sensor surface 31, 32, 41 of the rotational cam 30, 40 by means of a spring 18 or by means of any other equivalent element. Also, the abutment zones 14 and 15 can easily be obtained by simply arranging a scallop 14 whose base is used to constitute the abutment zone 15 as represented in FIGS. 8 through 10.

The instant application is based upon the French priority patent application No. 96.10873, filed on Sep. 4, 1996, the disclosure of which is hereby expressly incorporated by reference thereto, and the priority of which is hereby claimed under 35 USC 119.

What is claimed is:

1. A rigid shell sports boot comprising:

a shell base overhung with an upper adapted to pivot in both a front-to-rear and rear-to-front directions, the upper being provided, in a dorsal zone with an immobilization device with respect to the shell base, said device being active in at least one of the pivoting directions by means of an abutment zone obtained on said shell base, the immobilization device being equipped with a maneuvering member equipped with a rotational cam that acts on a mobile element adapted to cooperate, in a given angular position of the cam, with the abutment zone of the shell base, wherein the immobilization device comprises a second mobile element that can be actuated by means of the rotational cam and that is adapted to cooperate with a second abutment zone obtained on the shell base in at least one given angular position of the cam, the cooperation of such second mobile element with such second abutment zone being adapted to bring about the immobilization of the upper in at least one of its two pivoting directions, the cooperation of the first mobile element with the first abutment zone bringing about the immobilization of the upper in the other of its two pivoting directions.

2. A boot according to claim 1, wherein the rotational cam is constituted of a plate, which is at an axis on the maneuvering member and comprises at least one circular sensor surface having a high working zone and a low working zone and wherein the two mobile elements of the immobilization device cooperate with this sensor surface via a sensor member with which they are equipped respectively.

3. A boot according to claim 2, wherein at least one of the mobile elements of the immobilization device is pivotally mounted about an axis and subjected to the action of a spring that ensures the permanent maintenance of its sensor member on the sensor surface of the rotational cam.

4. A boot according to claim 2, wherein at least one of the mobile elements of the immobilization device can be translationally displaced in a guide and subjected to the action of a spring that ensures the permanent maintenance of its sensor member on the sensor surface of the rotational cam.

5. A boot according to claim 2, wherein the sensor members come into contact with the sensor surface of the cam at a distance from one another, each along one of the working zones, that is, the high working zone and the low working zone at opposing points with respect to the rotational axis of the cam.

6. A boot according to claim 5, wherein the plate constituting the rotational cam comprises two sensor surfaces, that is, one on each face, parallel to one another and each having a high working zone and a low working zone, each mobile element cooperating with one of the two sensor surfaces of the cam by means of its sensor member.

7. A boot according to claim 5, wherein the plate constituting the rotational cam comprises a single sensor surface having, over 360°, two humps in the shape of arcs of a circle having the same height and different lengths, defining between them two notches that are symmetrically opposed to them, the humps constituting the high working zone and the notches constituting the low working zone.

8. A boot according to claim 1, wherein the two abutment zones obtained on the shell base are located in the heel portion thereof, and wherein each abutment zone is adapted to respectively ensure the immobilization of the upper in only one of its pivoting directions, that is, front-to-rear and rear-to-front directions.

9. A boot according to claim 8, wherein the shell base has, in its heel portion a vertical scallop open upwardly and demarcated by flexible edges and that is covered by the dorsal zone of the upper, this scallop allowing the upper to pivot in the rear-to-front direction by virtue of the possible elastic deformation of its edges that can come closer together, and wherein one of the mobile elements of the immobilization device is adapted to cooperate with the scallop by getting inserted therein under the action of the rotational cam, in a given angular position thereof, so as to stop the reciprocal coming together of the edges of the scallop, which thus constitutes the abutment zone causing the immobilization of the upper in the rear-to-front direction.

10. A boot according to claim 9, wherein in its heel portion, the shell base has a shoulder located transversely with respect to the vertical scallop and beneath the latter, with which the other mobile element of the immobilization device is adapted to cooperate by taking support thereupon under the action of the rotational cam, in a given angular position thereof, such shoulder constituting the abutment zone causing the immobilization of the upper in the front-to-rear direction.

* * * * *